US010193253B2

(12) United States Patent
Li et al.

(10) Patent No.: US 10,193,253 B2
(45) Date of Patent: Jan. 29, 2019

(54) SLANTED TYPE CARD EDGE CONNECTOR ASSEMBLY

(71) Applicant: FOXCONN INTERCONNECT TECHNOLOGY LIMITED, Grand Cayman (KY)

(72) Inventors: Zhuang-Xing Li, Kunshan (CN); Wen-Jun Tang, Kunshan (CN); Xue-Wu Bu, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/697,397

(22) Filed: Sep. 6, 2017

(65) Prior Publication Data

US 2018/0069334 A1 Mar. 8, 2018

(30) Foreign Application Priority Data

Sep. 6, 2016 (CN) ..... 2016 1 0804262

(51) Int. Cl.

| | |
|---|---|
| ***H01R 12/72*** | (2011.01) |
| ***H01R 12/71*** | (2011.01) |
| ***H01R 12/83*** | (2011.01) |
| *H01R 12/57* | (2011.01) |
| *H01R 12/70* | (2011.01) |
| *H01R 13/447* | (2006.01) |
| *H01R 13/436* | (2006.01) |
| *H01R 13/506* | (2006.01) |

(52) U.S. Cl.

CPC ..... *H01R 12/721* (2013.01); *H01R 12/716* (2013.01); *H01R 12/724* (2013.01); *H01R 12/83* (2013.01); *H01R 12/57* (2013.01); *H01R 12/7029* (2013.01); *H01R 13/4364* (2013.01); *H01R 13/447* (2013.01); *H01R 13/506* (2013.01)

(58) Field of Classification Search

CPC ... H01R 12/721; H01R 12/716; H01R 12/724

USPC ..... 439/630

See application file for complete search history.

(56) References Cited

U.S. PATENT DOCUMENTS 4,756,694 A * 7/1988 Billman ..... H01R 12/721 439/328

5,013,264 A * 5/1991 Tondreault ..... H01R 12/721 439/636

(Continued)

FOREIGN PATENT DOCUMENTS

CN 202076454 U 12/2011

CN 203225430 U 10/2013

*Primary Examiner* — Alexander Gilman

(74) *Attorney, Agent, or Firm* — Wei Te Chung; Ming Chieh Chang

(57) ABSTRACT

A card edge connector includes an insulative housing with a pair of opposite side walls extending along a longitudinal direction with a central slot therebetween in the transverse direction perpendicular to the longitudinal direction. A pair of towers are located at two opposite ends of the housing in the longitudinal direction. The housing is essentially obliquely mounted upon a printed circuit board. Each tower has a lower/first part and an upper/second part in the vertical direction perpendicular to the longitudinal direction and the transverse direction. The width dimension in the transverse direction of the upper part is smaller than that of the lower part.

13 Claims, 20 Drawing Sheets

(56) References Cited

U.S. PATENT DOCUMENTS 5,511,985 A * 4/1996 Noschese ..... H01R 12/716 439/157
5,915,979 A * 6/1999 Schell ..... H01R 12/57 439/326
5,931,701 A * 8/1999 Pan ..... H01R 23/70 439/637
5,961,346 A * 10/1999 Choy ..... H01R 12/7029 439/326
5,964,606 A * 10/1999 Choy ..... H01R 12/7005 439/160
6,116,917 A * 9/2000 Choy ..... H01R 12/716 439/79
6,168,464 B1 * 1/2001 Choy ..... H01R 12/7029 439/567
6,176,723 B1 * 1/2001 Sakata ..... H01R 12/83 439/326
6,176,737 B1 * 1/2001 Choy ..... H01R 13/6456 439/541.5
6,203,338 B1 * 3/2001 Choy ..... H01R 12/721 439/83
6,979,206 B2 * 12/2005 Bu ..... H01R 12/721 439/79
7,473,140 B2 * 1/2009 Guan ..... H01R 12/721 439/637
7,789,681 B2 * 9/2010 Guan ..... H01R 12/721 439/157
8,398,422 B2 * 3/2013 Zhu ..... H01R 13/428 439/326
8,449,334 B2 * 5/2013 Wang ..... H01R 12/73 439/630
8,556,662 B2 * 10/2013 Wang ..... H01R 12/721 439/325
8,747,133 B2 * 6/2014 Shen ..... H01R 12/7005 439/157
9,240,640 B2 * 1/2016 Shen ..... H01R 12/7029
2009/0291581 A1 * 11/2009 Zhu ..... H01R 12/722 439/325
2013/0040498 A1 * 2/2013 Cai ..... H01R 12/721 439/636
2013/0084723 A1 * 4/2013 Shen ..... H01R 12/7029 439/159

* cited by examiner

SLANTED TYPE CARD EDGE CONNECTOR ASSEMBLY

BACKGROUND OF THE INVENTION

1. Field of the Invention

The present invention relates to a card edge connector, and particularly to a slanted type card edge connector.

2. Description of Related Arts

U.S. Pat. No. 5,964,606 discloses a slanted type card edge connector including an insulative housing having a pair of opposite side walls extending along a longitudinal direction with a central slot therebetween in the transverse direction, a mounting face for mounting to a printed circuit board, and a pair of towers respectively located by two opposite ends of the housing and extending perpendicular to the corresponding side walls. The tower essentially has a same dimension in the transverse direction so it is relatively difficult to reduce the distance between two neighboring slanted type connectors in the front-to-back direction on the printed circuit board when two slanted type card edge connectors are densely positioned with each other in the front-to-back direction.

A new design for densely arranging two slanted type card edge connectors in the front-to-back direction is desired.

SUMMARY OF THE INVENTION

A card edge connector includes an insulative housing with a pair of opposite side walls extending along a longitudinal direction with a central slot therebetween in the transverse direction perpendicular to the longitudinal direction. A pair of towers are located at two opposite ends of the housing in the longitudinal direction. The housing is essentially obliquely mounted upon a printed circuit board with a mounting face in the bottom so as to have an acute angle formed between the mounting face and the downward exterior surface of the lower side wall. A pair of rotatble ejectors are disposed in the corresponding towers, respectively. Each tower has a lower/first part and an upper/second part in the vertical direction perpendicular to the longitudinal direction and the transverse direction. The width dimension in the transverse direction of the upper part is smaller than that of the lower part. Therefore, when two slanted type card edge connectors are densely arranged with each other along the front-to-back direction on the printed circuit board, the upper part of the front card edge connector is essentially intimately located above the bottom region of the lower part of the rear card edge connector in the transverse direction, and a portion of the lower part of the rear card edge connector is intimately located above and aligned with a corresponding portion of the lower part of the front card edge connector in the vertical direction for achieving the maximum density for saving space on the printed circuit board.

DETAILED DESCRIPTION OF THE PREFERRED EMBODIMENT

Figure 1:
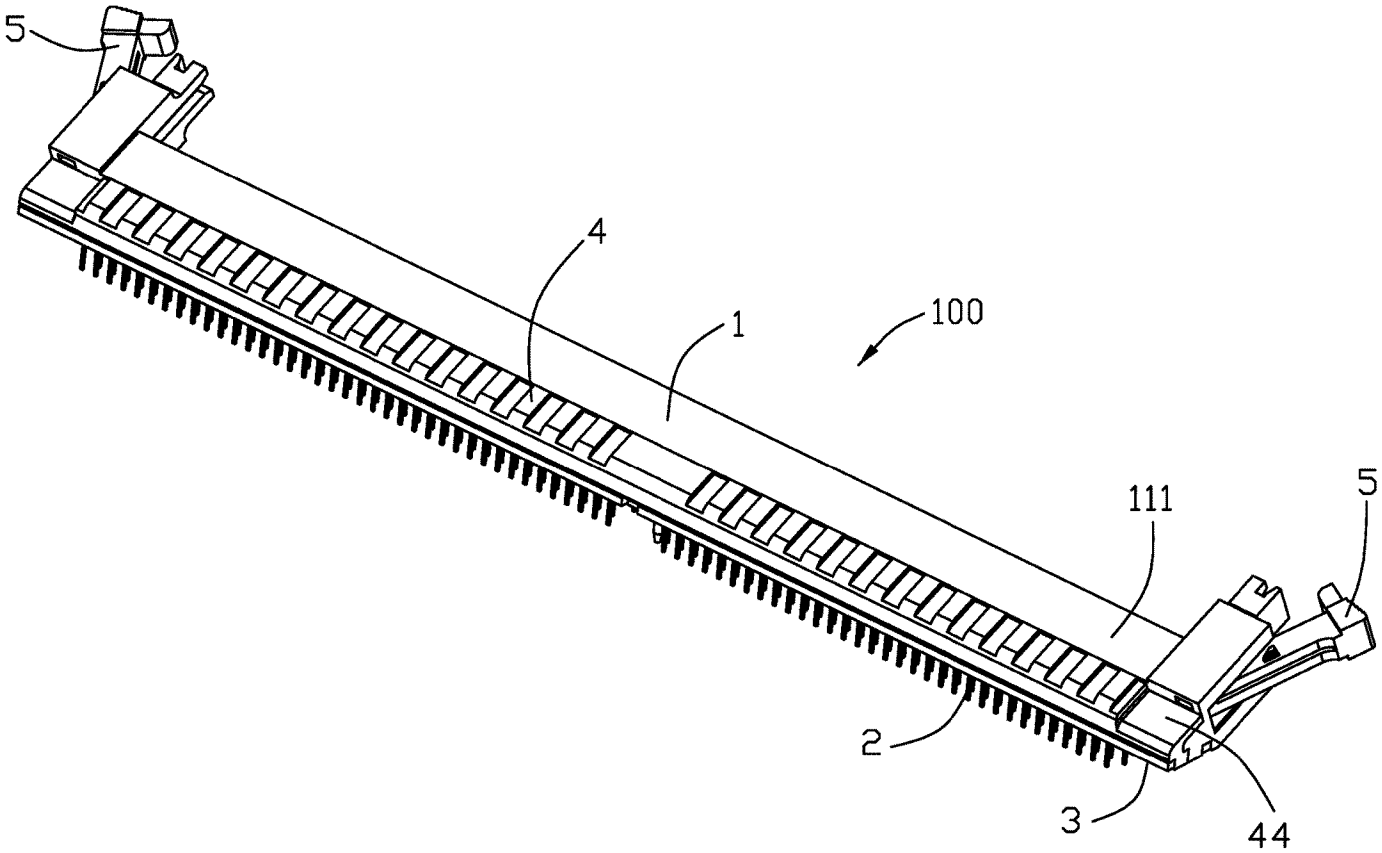
FIG. 1 is a perspective view of a card edge connector according to the first embodiment of the invention.
Figure 2:
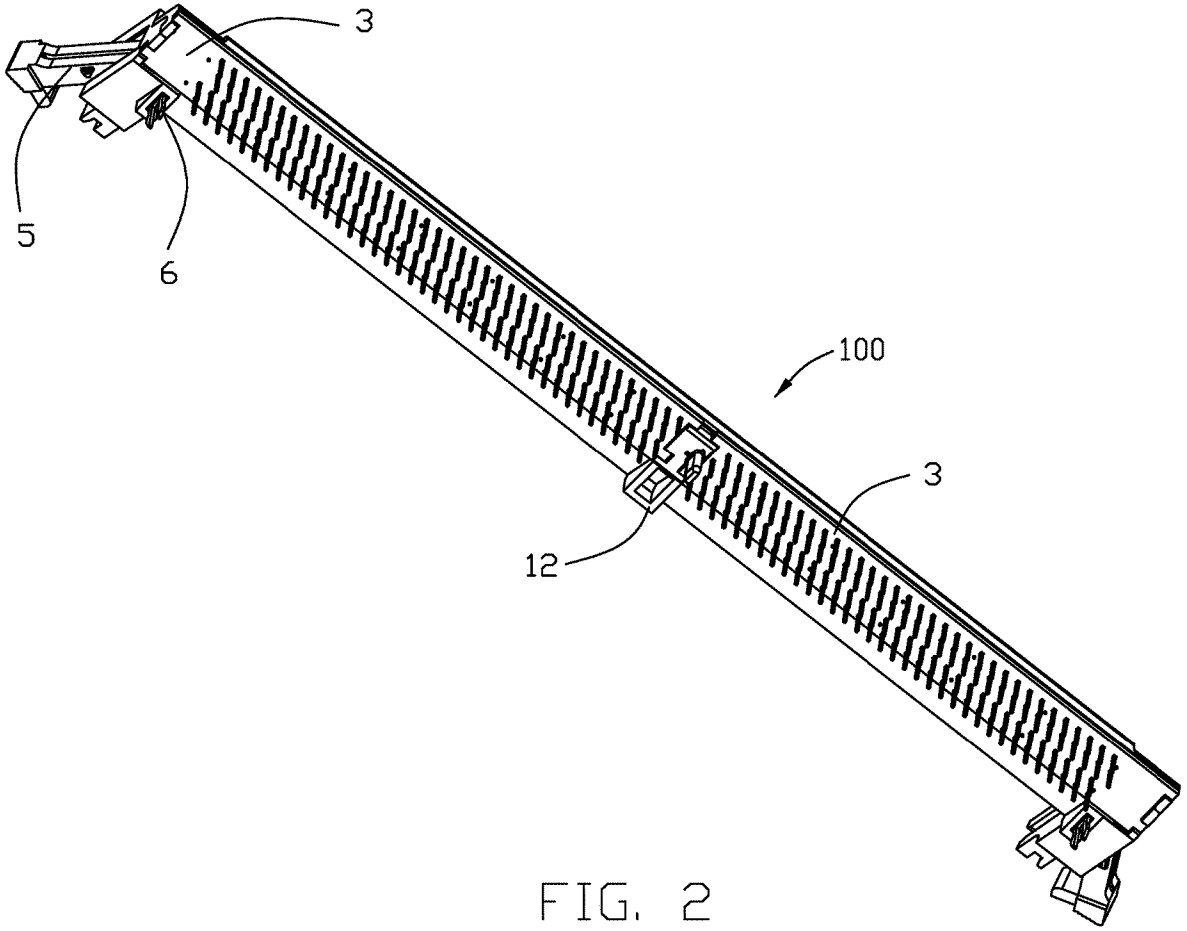
FIG. 2 is another perspective view of the card edge connector of FIG. 1.
Figure 3:
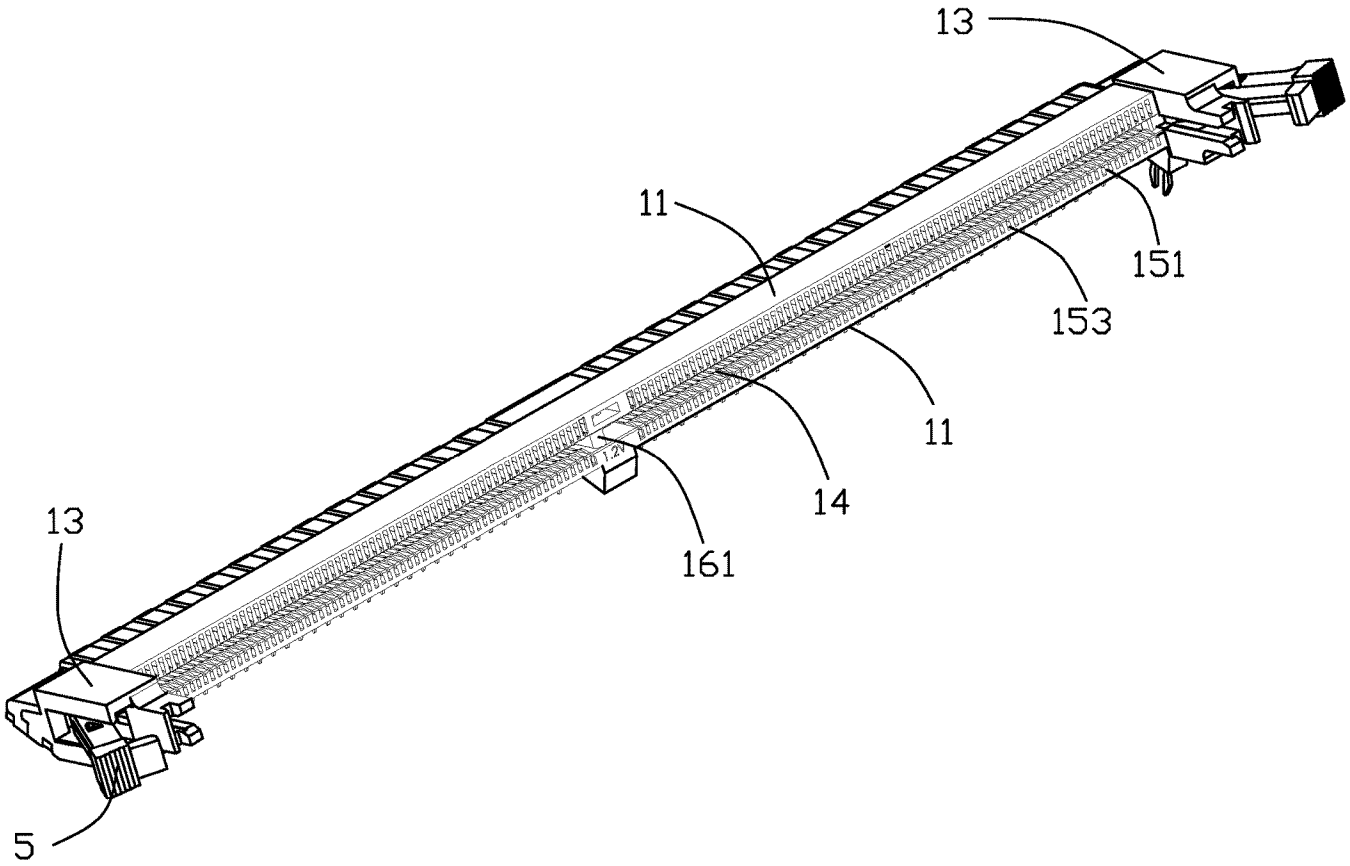
FIG. 3 is another perspective view of the card edge connector of FIG. 1.
Figure 4:
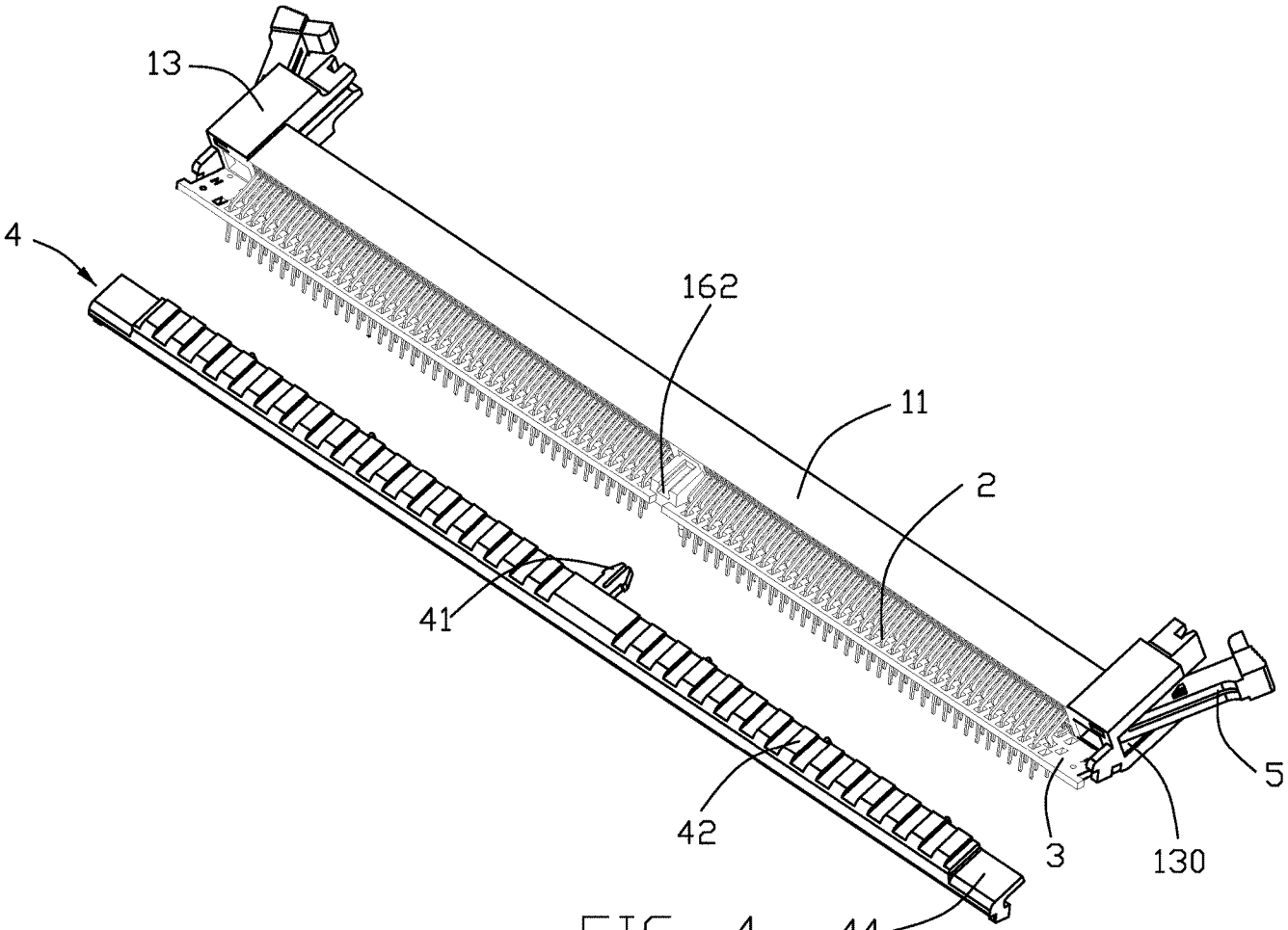
FIG. 4 is an exploded perspective view of the card edge connector of FIG. 1.
Figure 5:
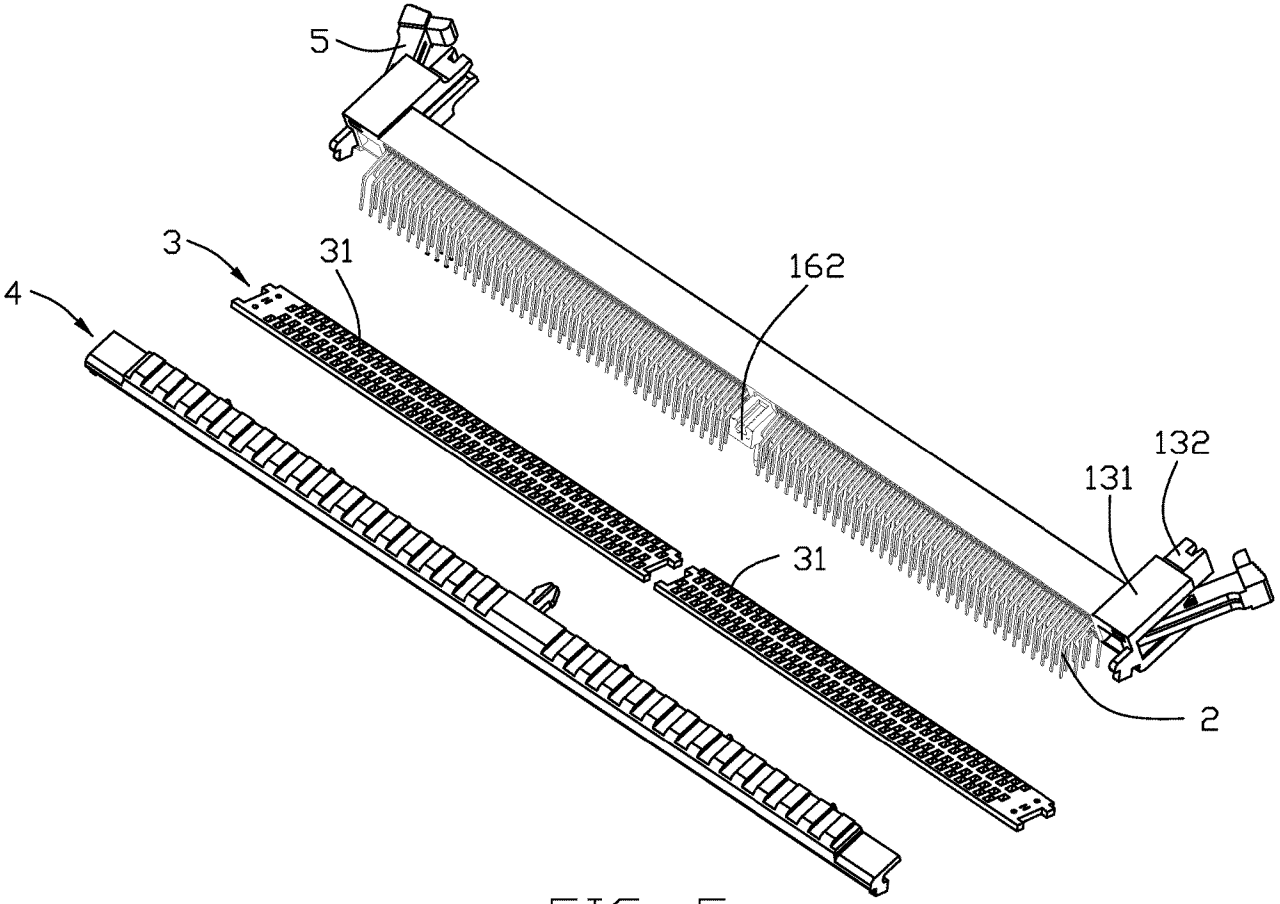
FIG. 5 a further exploded perspective view of the card edge connector of FIG. 4.
Figure 6:
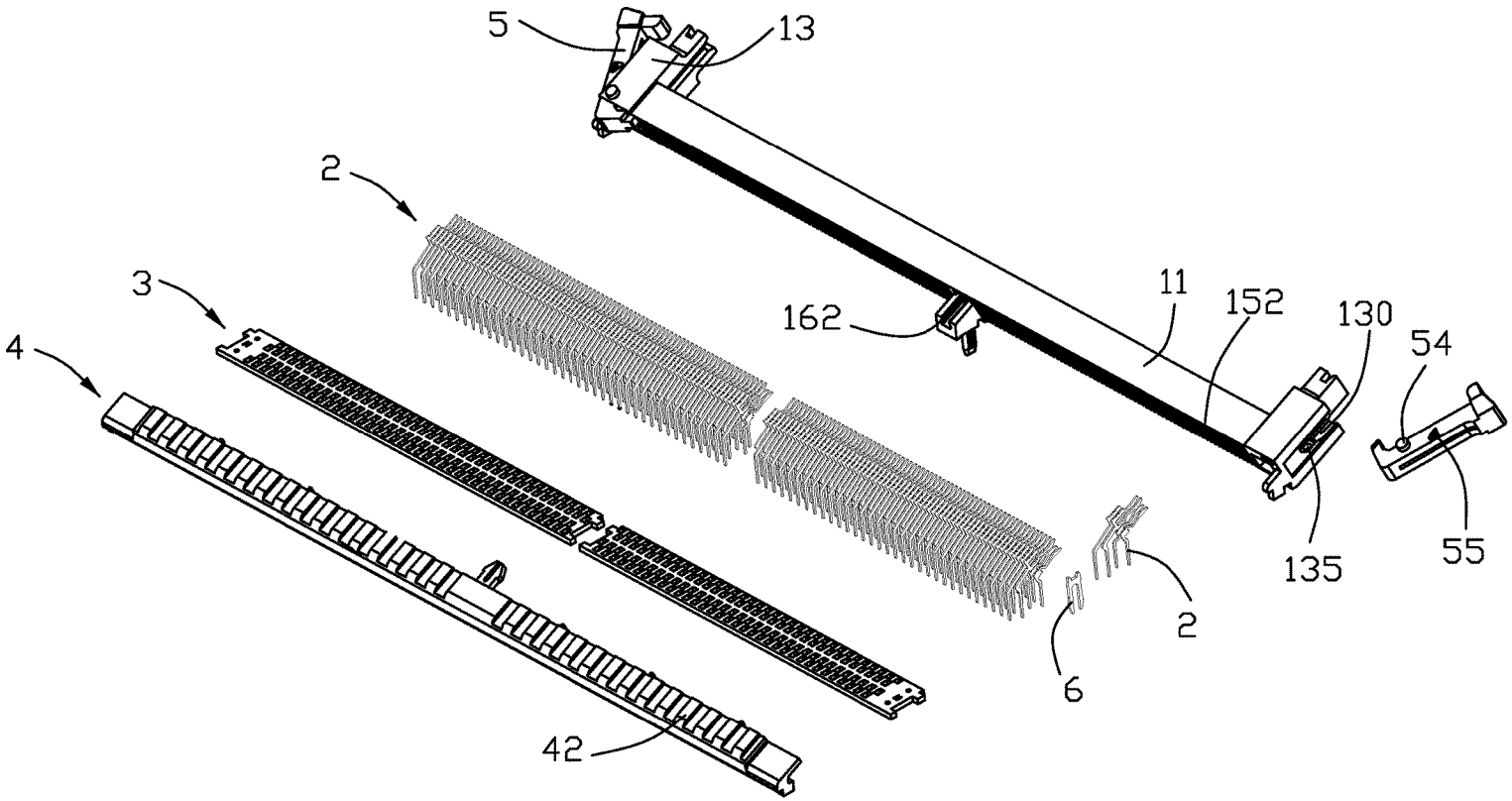
FIG. 6 is a further exploded perspective view of the card edge connector of FIG. 5.
Figure 7:
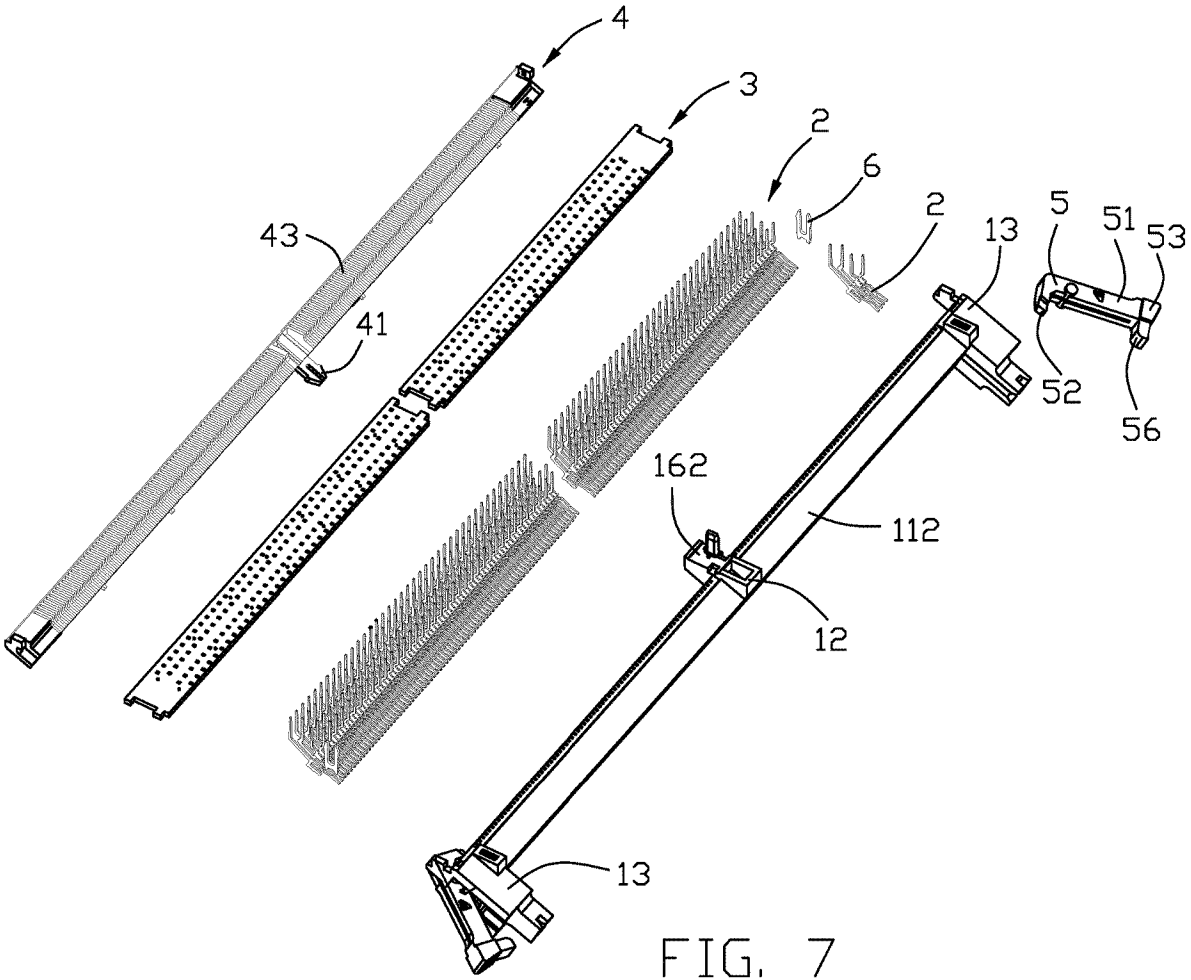
FIG. 7 is another exploded perspective view of the card edge connector of FIG. 6.

A card edge connector 100 includes an insulative housing 1, a plurality of terminals 2, two insulative fixing blocks 3, an insulative cover 4 and a board lock 6.

Figure 8:
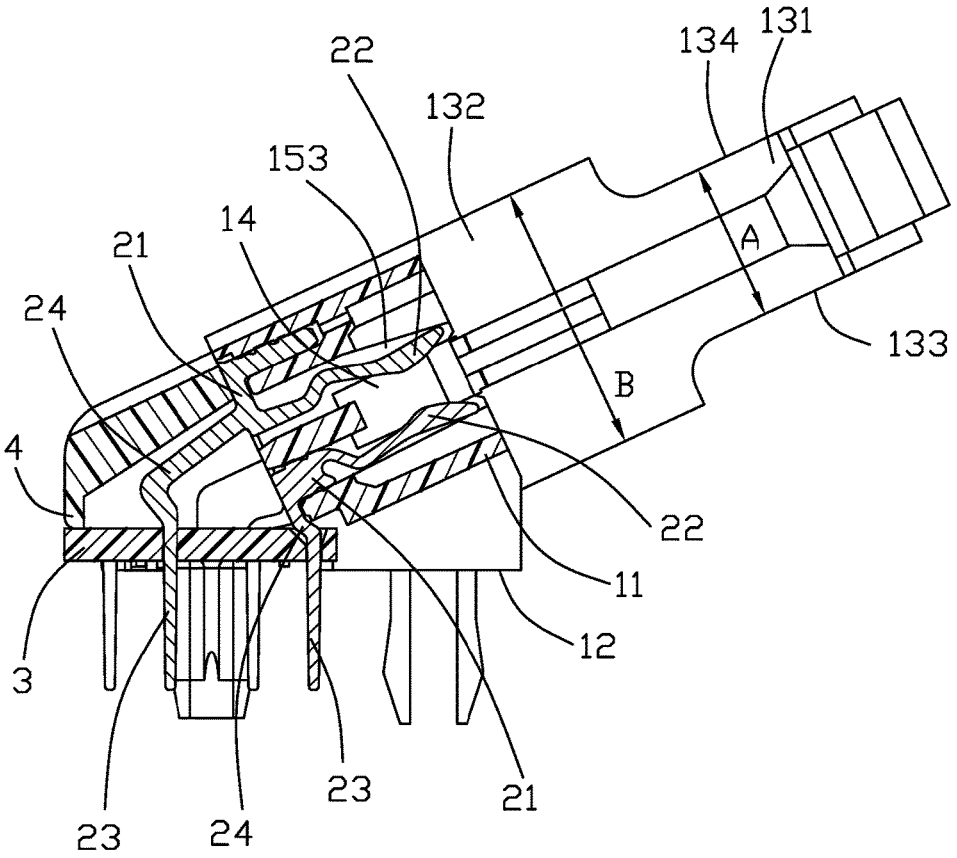
FIG. 8 is a cross-sectional view of the card edge connector of FIG. 1.
Figure 9:
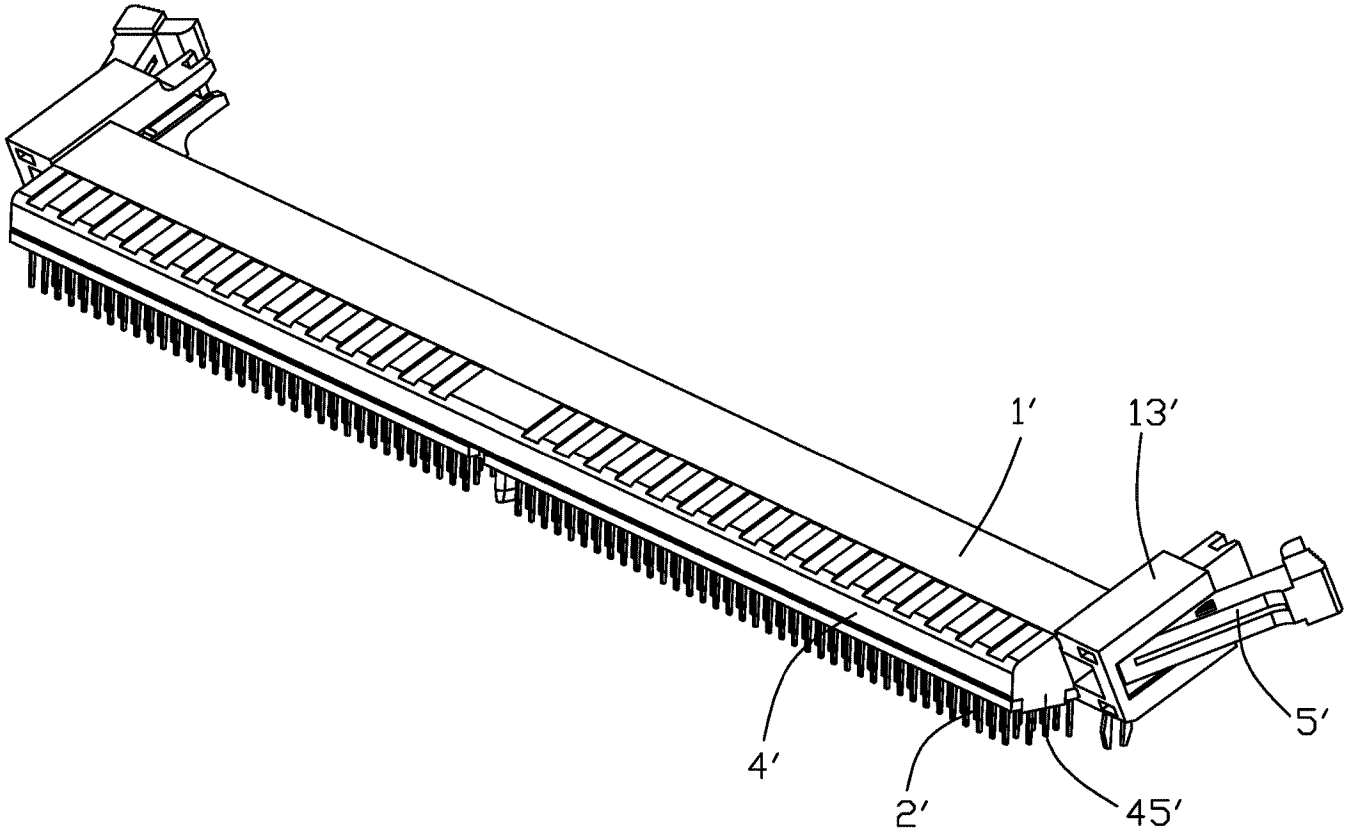
FIG. 9 is a perspective view of the card edge connector according to a second embodiment of the invention.
Figure 10:
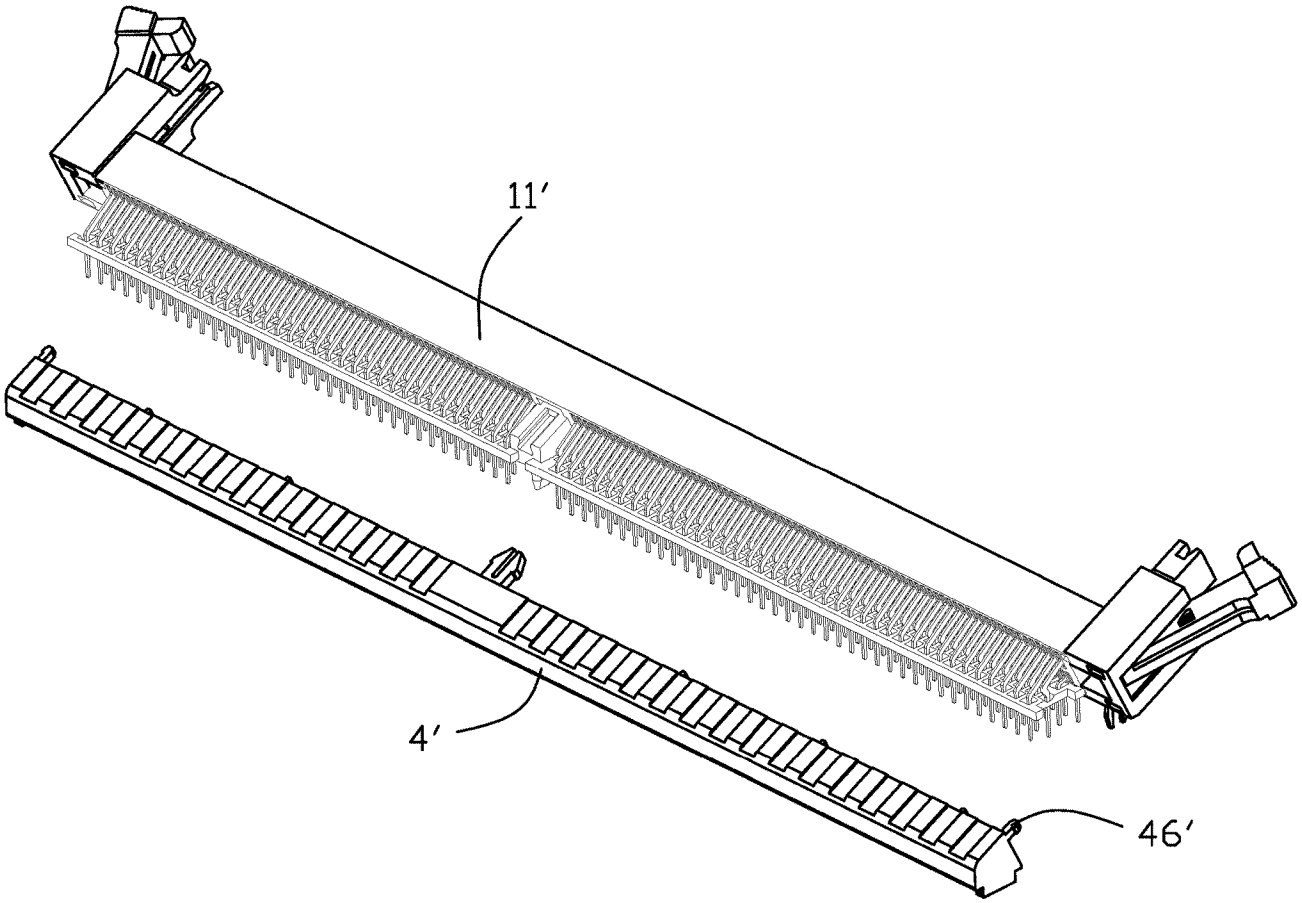
FIG. 10 is an exploded perspective view of the card edge connector of FIG. 9.
Figure 11:
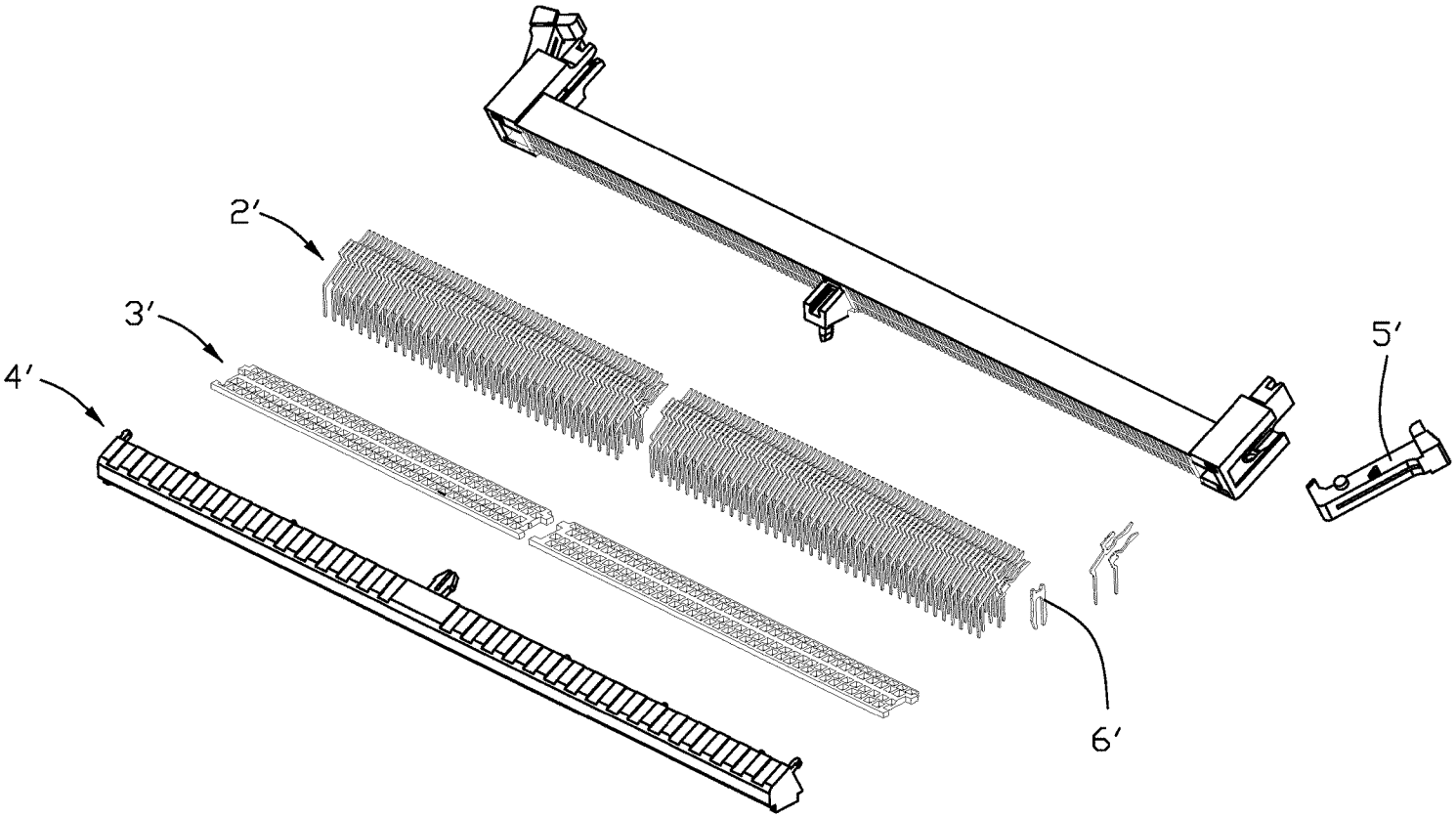
FIG. 11 is a further exploded perspective view of the card edge connector of FIG. 10.
Figure 12:
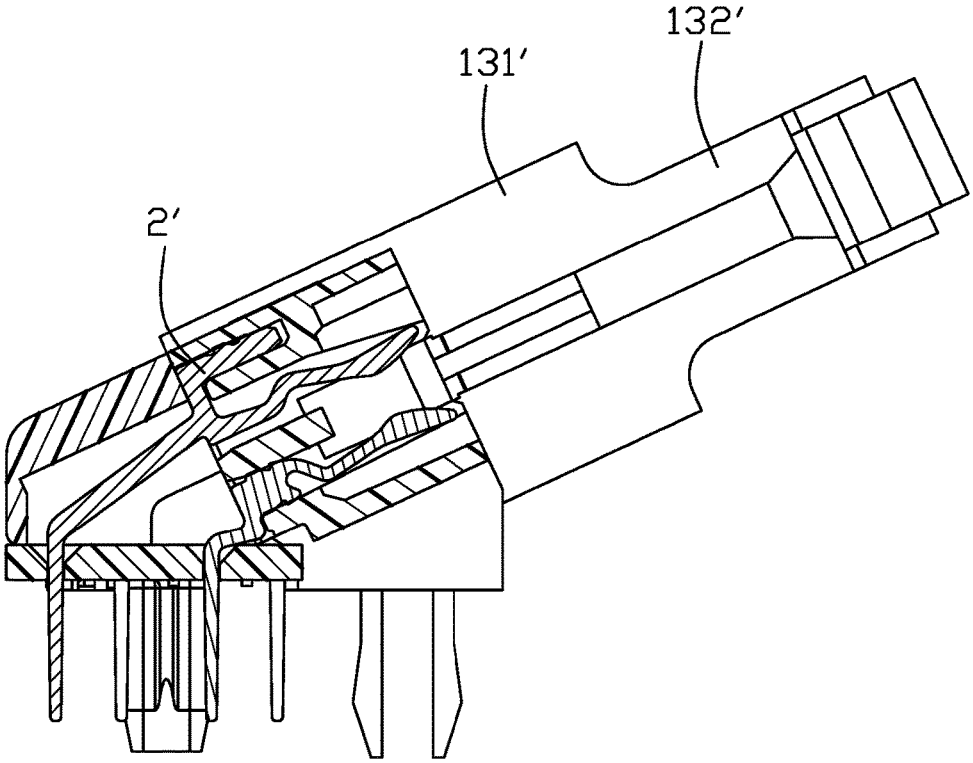
FIG. 12 is a cross-sectional view of the card edge connector of FIG. 9.
Figure 13:
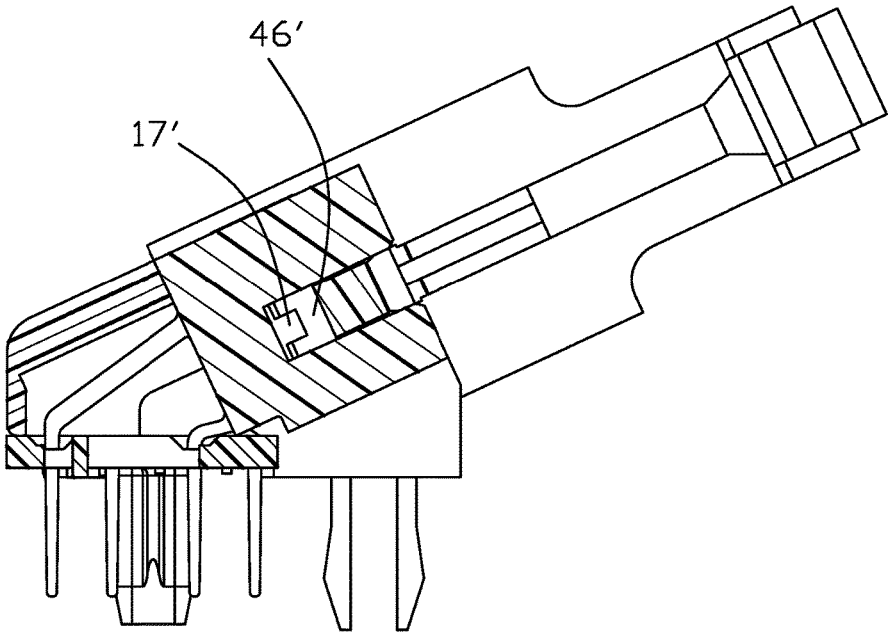
FIG. 13 is another cross-sectional view of the card edge connector FIG. 9.
Figure 14:
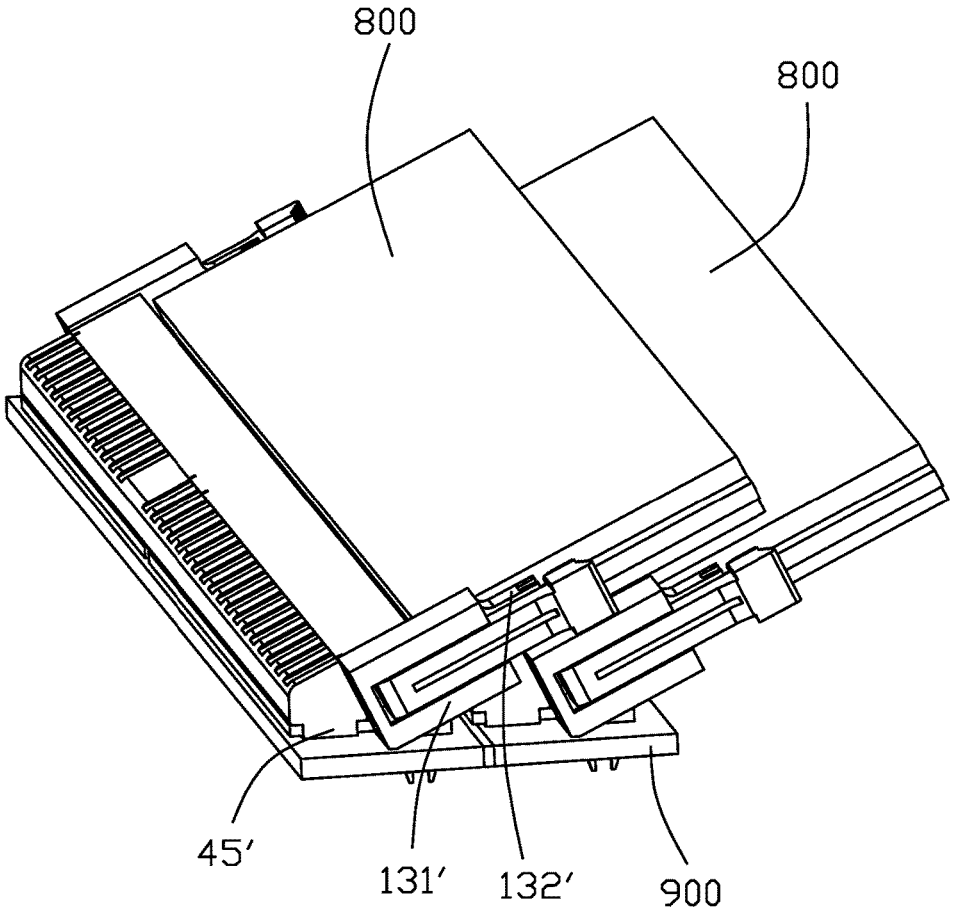
FIG. 14 is a perspective view of the card edge connector assembly having two card edge connectors densely disposed upon a printed circuit board in the front-to-back direction.

Referring to FIGS. 1-8, the insulative housing 1 includes a pair of side walls 11 extending along a longitudinal direction, a mounting face 12, a pair of towers 13 located at two opposite ends of the housing 1 and extending in a vertical direction perpendicular to the longitudinal direction. A central slot 14 is formed between the pair of side walls in the transverse direction perpendicular to both the longitudinal direction and the vertical direction. The housing 1 is obliquely mounted upon a printed circuit board with an acute angle formed between an exterior surface of the lower side wall and the mounting face 12. In other words, the housing 1 essentially extends in a plane, which is defined by the longitudinal direction and the vertical direction, is perpendicular to the transverse direction while being oblique to the mounting face 12. In generally, such an acute angle is 25 degrees. The tower 13 forms a receiving space 130 in which an ejector 5 is pivotally mounted. The tower 13 includes a lower/first part 131 and an upper/second part 132. As shown in FIG. 8, a width A of upper part 132 in the transverse direction is smaller than the width B of the lower part 131. In other words, a pair of recesses (not labled) in the upper part 132 compared with the lower part 131. Further referring to FIGS. 14-15, the connector 100 is used to connect a module 800 to the printed circuit board 900. Notably, the width A is defined between the exterior surface 133 of the upper part 132 and the exterior surface 134 of the upper part 132. The housing 1 forms a front face 152 and the rear face 151 with a plurality of passageways 153 therebetween. The housing 1 further forms an upward face 111 and a downward face 112. The housing further includes a key 161 to divide the central slot 14, and a divider 162 corresponding the to key 161.

The terminals 2 are disposed in the passageways 153 by two sides of the central slot 14. Each terminal 2 includes a base 21 retained to the corresponding side wall 11, a contacting section 22 extending from one side of the base 21 into the central slot 14, a mounting section 23 extending from the other side of the base 21 out of the housing 1, and an extension 24 between the base 21 and the mounting section 23. In this embodiment, the upper row terminal 2 has a retention post (not labeled) beside the contacting section 22 while the lower row terminal 2 has the base 21 with barbs thereon for retention.

The fixing block 3 is located between the tower 13 and the divider 162 and includes four rows of through holes 31 to receive the corresponding mounting section 23 of the terminals 2.

The cover 4 is mounted upon the housing 1 and the fixing blocks 3 to cover the extensions 24. The cover 4 includes a hook 41 for securing to the housing 1, a plurality of ribs 42, a plurality of slots 43 for receiving the corresponding extensions 24. In this embodiment, the cover 4 has the same dimension with the housing 1 along the longitudinal direction so as to form at two longitudinal ends a pair of upward faces 44 with corresponding recesses thereof for accommodating a lower part 131 of the tower 13 of a front neighboring connector 100 when two neighboring connectors 100 are densely arranged with each other along a front-to-back direction on the printed circuit board.

The ejector 5 includes a main body 51, a kicker 52 extending from the lower portion of the main body 51 and into the central slot 14, a handler 53 extending from the upper portion of the main body 51, and a locker 56 extending from the upper portion of the main body 51 opposite to the handler 53. The ejector 5 further includes a pair of pivotal shafts 54 for allowing the ejector 5 to be rotated in the receiving space 130, and a pair of engagement blocks 56 for retaining to the corresponding tower 13 when the ejector 5 is located in the locking position. A board lock 6 is used for securing to the printed circuit board.

Referring to FIGS. 9-15, in the second embodiment the ejector 5', the fixing blocks 3' and board lock 6' and terminals 2 are same with those in the first embodiment. The insulative housing 1 and the cover 4' are different from those in the first embodiment wherein the cover 4' is shortened along the longitudinal direction to be comply with only the side wall 11' but leaving the cutouts 45' in front of the corresponding tower 13' in comparison with the recesses 44 in the cover 4. The cover 4 includes a hook 46' to be engaged within the corresponding hole 17' in the housing 1'.

Referring to FIGS. 16-19, in the third embodiment the mounting sections 23" of the terminals 2" are mounted to the printed circuit board in a surface mounting manner rather than a through hole manner. The cover 4" further performs the tail retention function without the corresponding fixing blocks.

Figure 20:
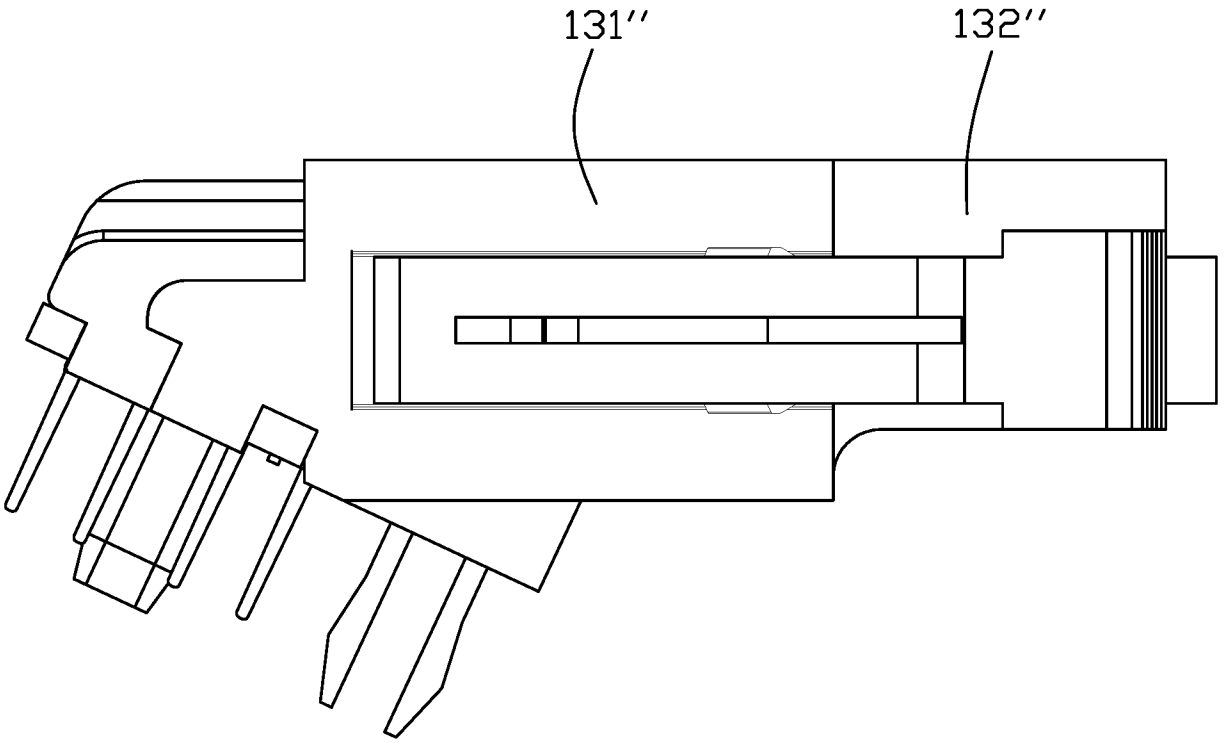
FIG. 20 is a side view of the card edge connector according to a fourth embodiment of the invention.

Referring to FIG. 20, in the fourth embodiment, the upper part 132 only has the downward recess for accommodating the bottom region of the lower part of the rear connector 100 when the two connectors 100 are densely arranged with each other in the front-to-back direction while the upward recess of the first embodiment no longer exists for increasing the strength of the tower 13.

Figure 15:
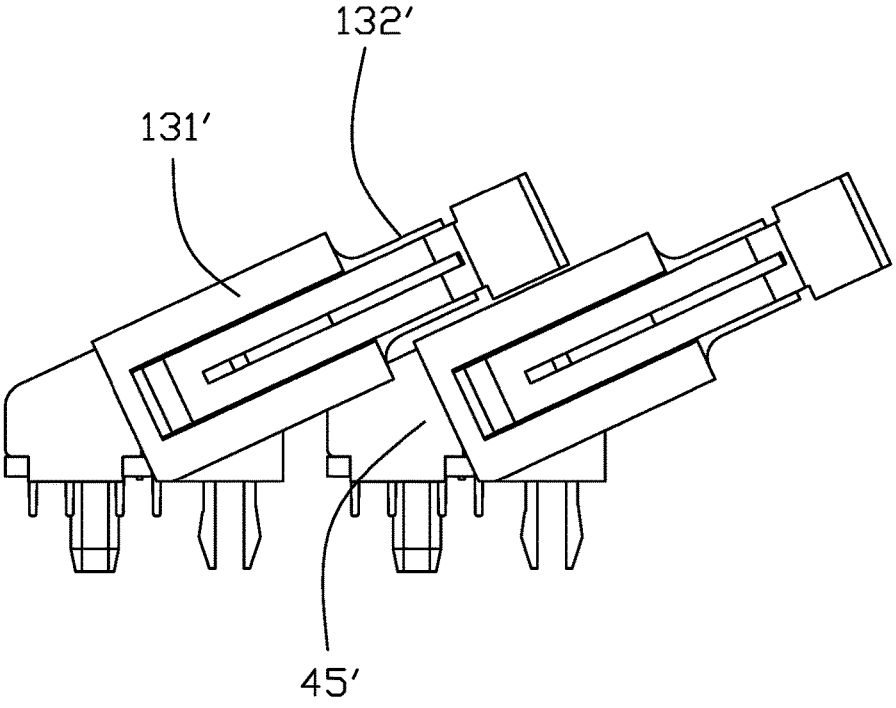
FIG. 15 is a side view of the two card edge connectors densely arranged with each other in the front-to-back direction of FIG. 14.
Figure 16:
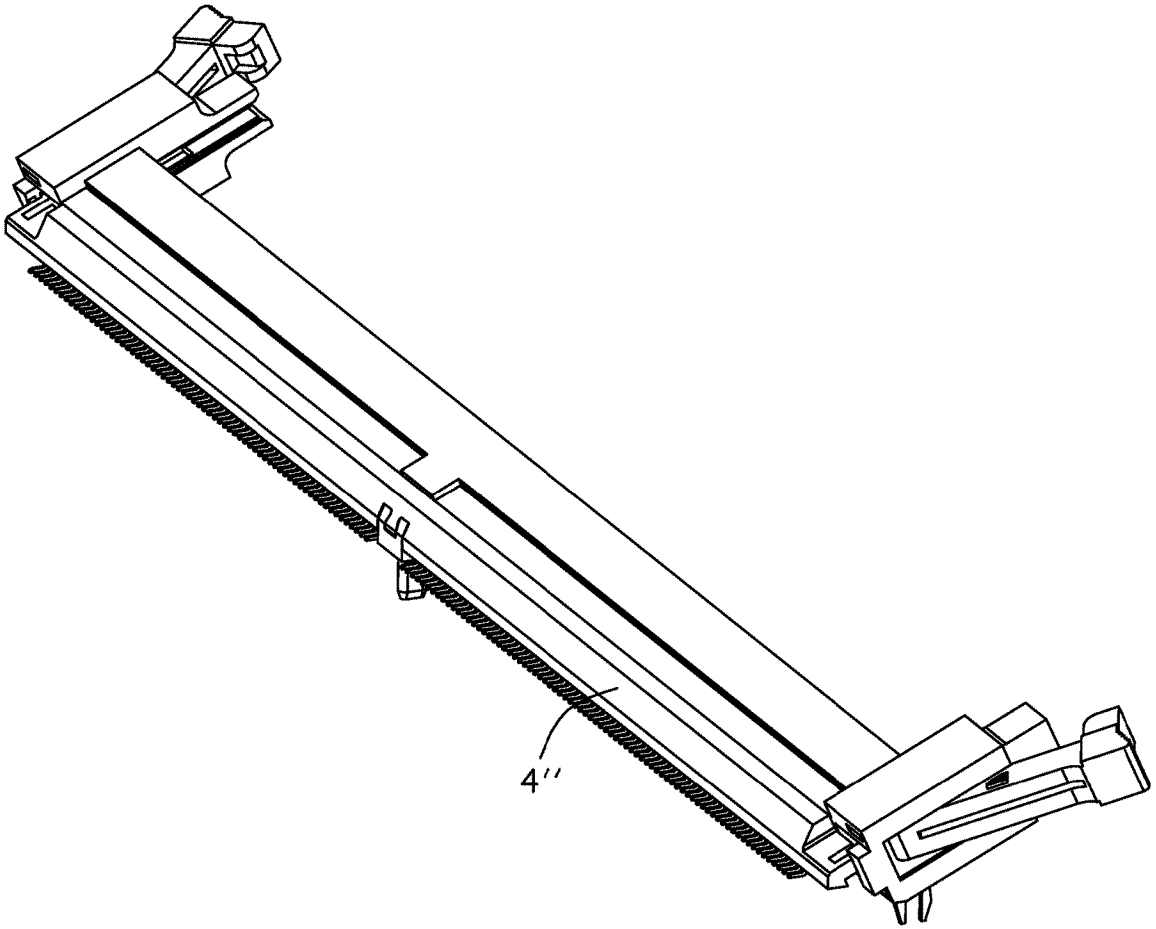
FIG. 16 is a perspective view of the card edge connector according to a third embodiment of the invention.
Figure 17:
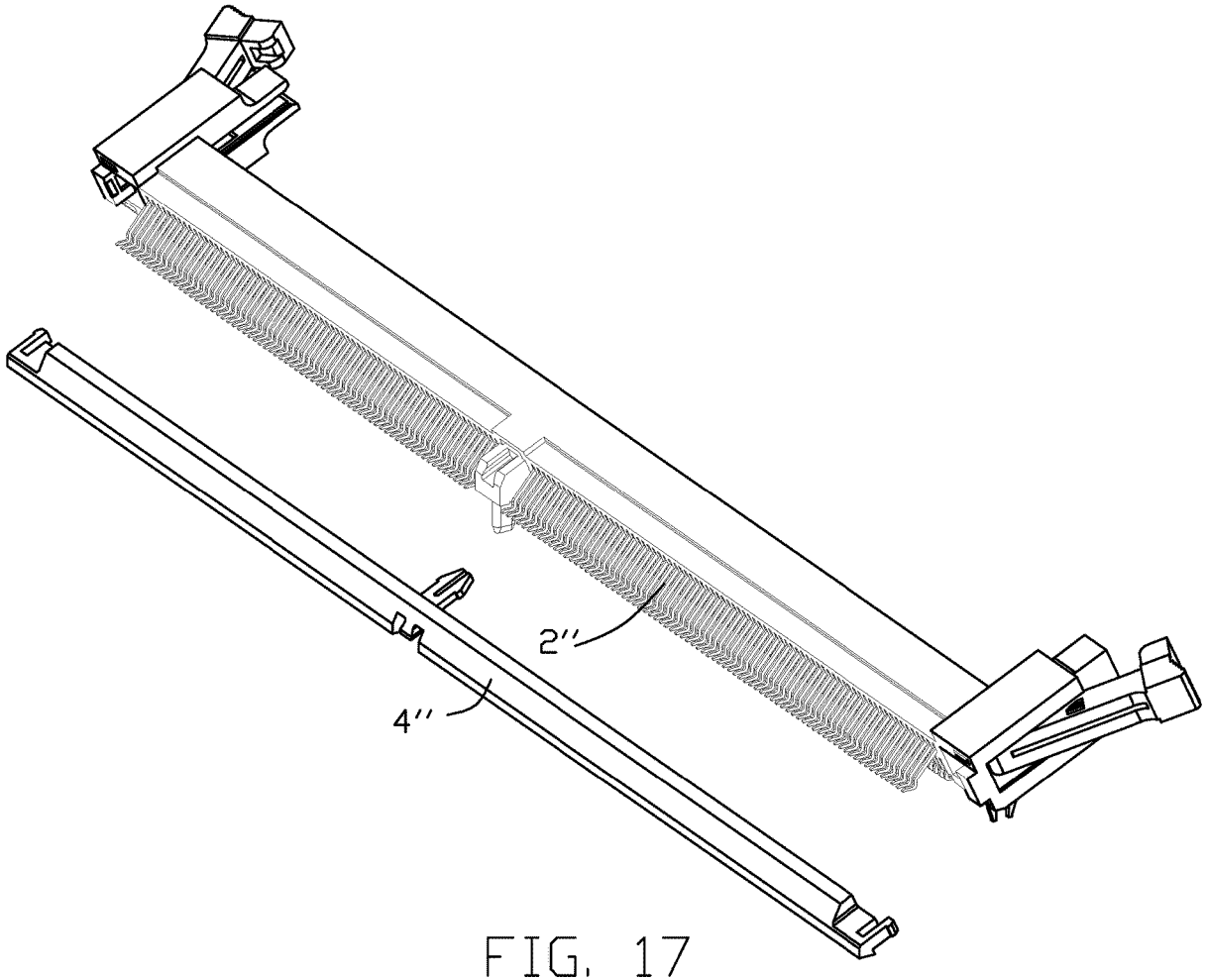
FIG. 17 is an exploded perspective view of the card edge connector of FIG. 16.
Figure 18:
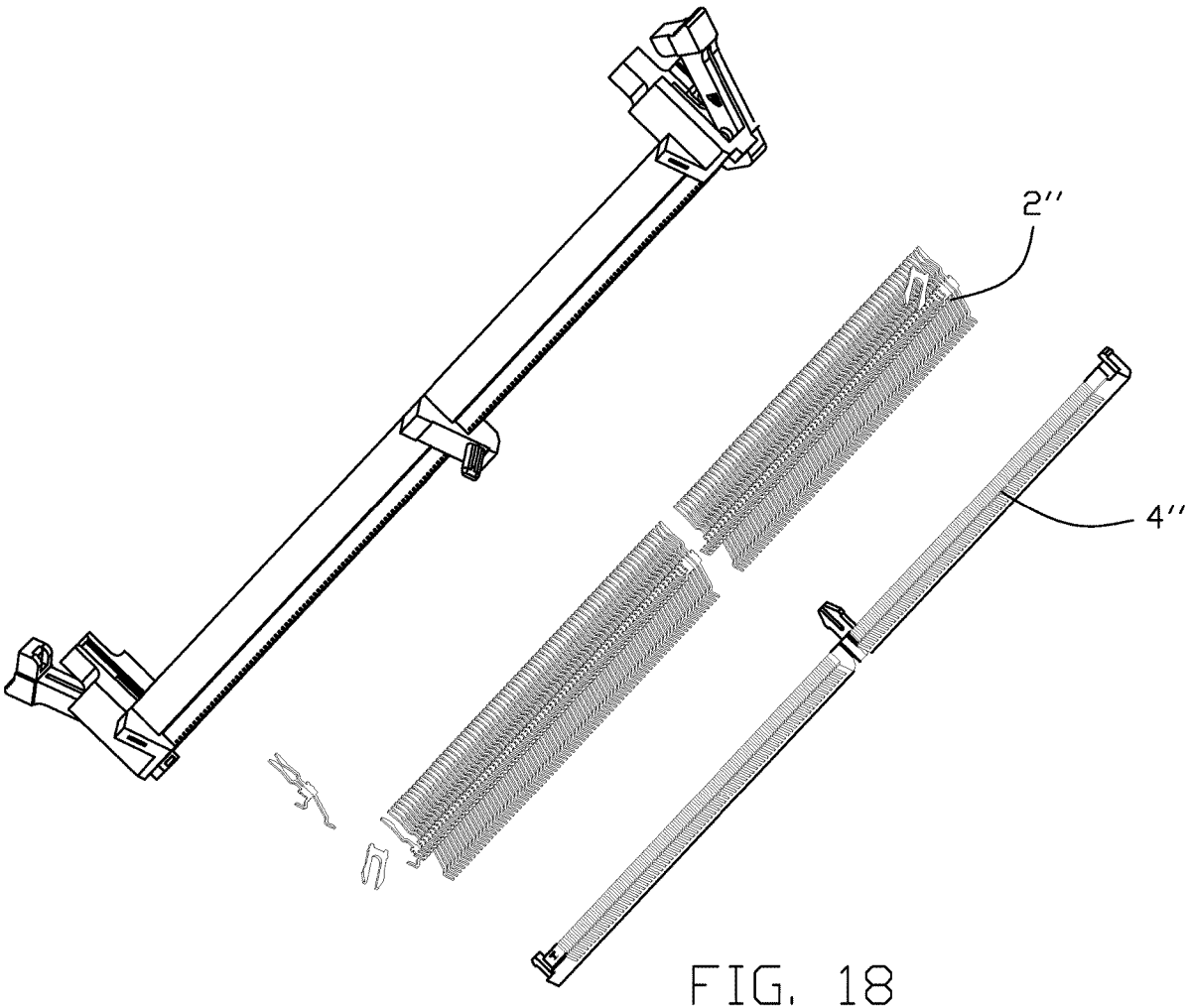
FIG. 18 is a further exploded perspective view of the card edge connector of FIG. 17.
Figure 19:
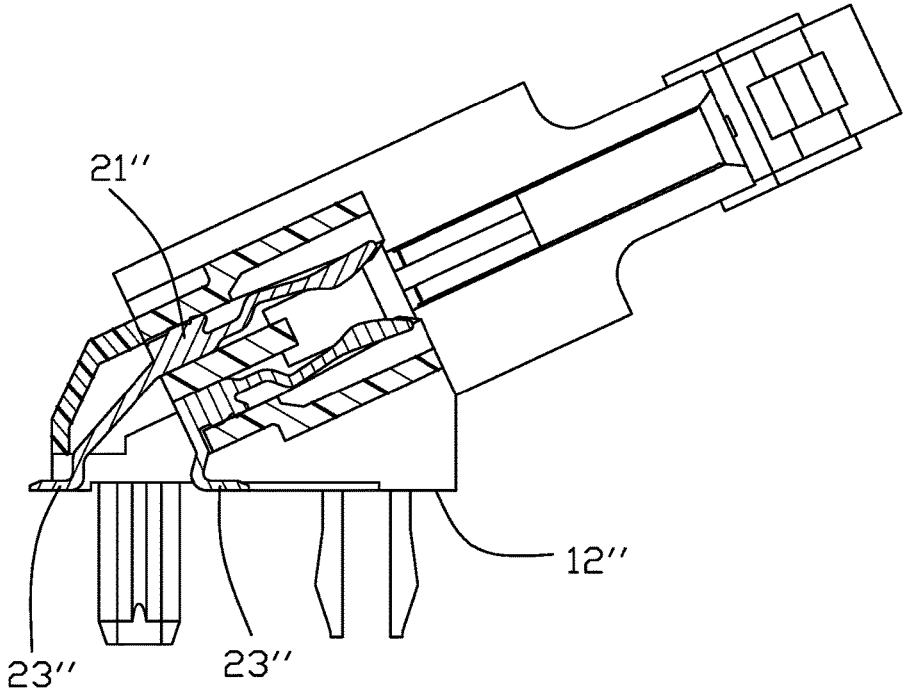
FIG. 19 is a cross-sectional view of the card edge connector of FIG. 16.

In brief, the feature of the invention is to provide a recessed upper part of the tower so as to have the bottom region of the lower part of the tower of the rear card edge connector received within the recess of the upper part of the tower of the front card edge connector without interference when the front card edge connector and the rear card edge connector are densely arranged with each other in the front-to-back direction which is perpendicular to the longitudinal direction while being oblique to the transverse direction and the vertical direction. Precisely speaking, such a recess is formed in a downward face of the upper part of the tower of the front card edge connector to receive an upward face of the bottom region of the lower part of the tower of the rear card edge connector as shown in FIG. 15. Another feature of the invention is to have the upper side wall wider than the lower side wall in the transverse direction so as to have the terminals 2 in the upper side wall has the additional retention post beside the corresponding contacting section 22 in the transverse direction.

What is claimed is:

1. A card edge connector for mounting to a printed circuit board, comprising:

an insulative housing including a pair of side walls extending along a longitudinal direction with a central slot therebeween in a transverse direction perpendicular to said longitudinal direction;

said housing forming a mounting face for mounting toward the printed circuit board wherein the housing extends in a plane oblique to said mounting face;

a pair of towers located at two ends of the housing in said longitudinal direction, each of said towers including a lower part and an upper part extending in a vertical direction perpendicular to both said longitudinal direction and said transverse direction; and a pair of ejectors rotatably disposed in the corresponding towers, respectively; wherein a width of the upper part along the transverse direction is dimensioned smaller than that of the lower part for densely arranging, on the printed circuit board, two card edge connectors in a front-to-back direction which is perpendicular to the longitudinal direction while being oblique to both said vertical direction and said transverse direction;

wherein the upper part has a recess in a downward face for receiving a bottom region of the lower part of the tower of another card edge connector therebehind in said front-to-back direction.

2. The card edge connector as claimed in claim 1, further including a plurality of terminals by two sides of the central slot, wherein the side walls includes an upper side wall and a lower side wall with the central slot therebetween, and the terminals in the upper side wall are wider than those in the lower side wall in the transverse direction.

3. The card edge connector as claimed in claim 2, further including a cover to shield mounting sections of the corresponding terminals.

4. The card edge connector as claimed in claim 3, wherein said cover has a similar dimension with the housing in the longitudinal direction, and includes recesses in an upper surface at two ends thereof corresponding to the towers.

5. The card edge connector as claimed in claim 3, wherein said cover is shorter than the housing without reaching two opposite positions corresponding to the towers.

6. The card edge connector as claimed in claim 1, wherein said ejector includes a handler at a top end having a width similar to that of the upper part.

7. An electrical connector assembly comprising:

a printed circuit board;

a front connector and a rear connector same with each other and densely arranged upon the printed circuit board in a front-to-back direction, each of said front connector and said rear connector including:

an insulative housing including a pair of side walls extending along a longitudinal direction with a central slot therebeween in a transverse direction perpendicular to said longitudinal direction;

said housing forming a mounting face for mounting toward the printed circuit board wherein the housing extends in a plane oblique to said mounting face;

a pair of towers located at two ends of the housing in said longitudinal direction, each of said towers including a lower part and an upper part extending in a vertical direction perpendicular to both said longitudinal direction and said transverse direction; and a pair of ejectors rotatably disposed in the corresponding towers, respectively; wherein a width of the upper part along the transverse direction is dimensioned smaller than that of the lower part to form therein a recess so that the recess formed in the upper part of the tower of the front connector receives a bottom region of the lower part of the rear connector; wherein said front-to-back direction is perpendicular to the longitudinal direction while being oblique to both said vertical direction and said transverse direction.

8. The electrical connector assembly as claimed in claim 7, further including a plurality of terminals by two sides of the central slot, wherein the side walls includes an upper side wall and a lower side wall with the central slot therebetween, and the terminals in the upper side wall are wider than those in the lower side wall in the transverse direction.

9. The electrical connector assembly as claimed in claim 8, further including a cover to shield mounting sections of the corresponding terminals.

10. The electrical connector assembly as claimed in claim 9, wherein said cover has a similar dimension with the housing in the longitudinal direction, and includes recesses in an upper surface at two ends thereof corresponding to the towers.

11. The card edge connector as claimed in claim 9, wherein said cover is shorter than the housing without reaching two opposite positions corresponding to the towers.

12. The card edge connector as claimed in claim 7, wherein said ejector includes a handler at a top end having a width similar to that of the upper part.

13. A card edge connector for mounting to a printed circuit board, comprising:

an insulative housing including a pair of side walls extending along a longitudinal direction with a central slot therebeween in a transverse direction perpendicular to said longitudinal direction, said housing forming a mounting face for mounting toward the printed circuit board wherein the housing extends in a plane oblique to said mounting face;

a pair of towers located at two ends of the housing in said longitudinal direction, each of said towers including a lower part and an upper part extending in a vertical direction perpendicular to both said longitudinal direction and said transverse direction;

a pair of ejectors rotatably disposed in the corresponding towers, respectively; and a plurality of terminals by two sides of the central slot;

wherein the side walls includes an upper side wall and a lower side wall with the central slot therebetween, and the terminals in the upper side wall are wider than those in the lower side wall in the transverse direction;

wherein each of the terminals in the upper side wall has a base from which a retention post and a contacting section commonly extends in a spaced manner in the transverse direction while each of the terminals in the lower side wall has a barbed base from which a contacting section extends.

* * * * *